US007409980B1

(12) United States Patent
Heissenberg

(10) Patent No.: US 7,409,980 B1
(45) Date of Patent: Aug. 12, 2008

(54) ROLLING SHUTTER ASSEMBLY

(76) Inventor: Michael Heissenberg, 725 NE. Bayberry La., Jensen Bch., FL (US) 34957

( * ) Notice: Subject to any disclaimer, the term of this patent is extended or adjusted under 35 U.S.C. 154(b) by 0 days.

(21) Appl. No.: 11/737,330

(22) Filed: Apr. 19, 2007

(51) Int. Cl.
*E06B 9/08* (2006.01)

(52) U.S. Cl. ..... 160/133; 160/264

(58) Field of Classification Search ..... 160/133, 160/264, 235, 236, 134
See application file for complete search history.

(56) References Cited

U.S. PATENT DOCUMENTS 1,720,850 A * 7/1929 Negrini ..... 160/133
2,390,116 A * 12/1945 Michelman ..... 160/133
2,545,400 A * 3/1951 White ..... 160/133
5,205,336 A * 4/1993 Munekata et al. ..... 160/133
5,265,663 A * 11/1993 Munekata et al. ..... 160/133
5,575,322 A 11/1996 Miller
6,095,225 A * 8/2000 Miller ..... 160/133
6,422,289 B1 7/2002 Miller
6,779,582 B2 8/2004 Heissenberg
7,069,700 B2 7/2006 Heissenberg

* cited by examiner

*Primary Examiner*—Katherine Mitchell
*Assistant Examiner*—Candace L. Bradford
(74) *Attorney, Agent, or Firm*—McHale & Slavin, P.A.

(57) ABSTRACT

A rolling shutter assembly is formed of a plurality of shutter slats which are designed to fit snuggly against each other when in a rolled up state so as to substantially reduce the diameter of the rolled up shutter assembly. This reduction of the diameter of the shutter assembly permits the use of a smaller housing for the shutter assembly. The smaller housing increases the aesthetic appeal of the assembly and decreases the material required for the assembly housing and thus the cost of the shutter assembly. The rolling shutter assembly includes a shutter support member, a shutter coupled to the support member and a plurality of tracks the guide the shutter while it is being raised or lowered. The shutter slats include a hinge connection along each edge portion of the slats.

6 Claims, 5 Drawing Sheets

73
132
70
71
130
72
74
76
78
80
82
84
86
88

ROLLING SHUTTER ASSEMBLY

FIELD OF THE INVENTION

The present invention relates to the field of rolling protective shutters. The shutters include an assembly, for covering a window or door of a building, which can be compactly rolled up into a housing when not in use.

BACKGROUND OF THE INVENTION

Rolling protective shutters have long been used as protection against extreme weather conditions, such as hurricanes, and to deter theft. Conventionally, rolling protective shutters are made from a plurality of shutter blades or slats which are hingedly connected to each other. When deployed, these blades or slats form a surface which covers an opening in a building. When they are not in use they are stored in a housing or enclosure. They are normally wound around a rod or shaft for storage. An example of these rolling shutters is disclosed in U.S. Pat. No. 5,575,322, issued to Miller and entitled "Rolling Protective Shutters" which is incorporated by reference herein. As illustrated in FIGS. 1 and 2 the rolling shutter of Miller is composed of a plurality of individual slats and a plurality of hinges interconnecting the slats. The slats include a first set of slats and a second set of slats. Each of the slats in the first and second sets being alternated so that each of the hinges is connected to one of the slats in the first set and one of the slats in the second set. The shutter assembly also includes a pair of shutter track and means for rolling the shutters from an extended position to a retracted position in which the shutters are rolled up on a shutter support member. The size of the housing required to hold the rolled up shutters is substantially greater than the depth of the shutters when deployed and extends a substantial distance from the building, as illustrated in FIG. 1.

DESCRIPTION OF THE PRIOR ART

U.S. Pat. No. 5,575,322, issued to Miller discloses rolling shutter assembly for covering a door or window opening. The shutter is formed from a plurality of slats connected to each other. There are two different sets of slats. Each set of slats is different from the other set in size and connecting elements. The different sets are connected to each other in an alternating arrangement with the first set alternating with the second set. This arrangement allows the first set of slats to occupy a horizontal position when deployed and the second set to occupy a vertical or angled position when deployed. The second set of slats provides the majority of protection against high winds and weather. The problem with this type construction is that the slats occupy a substantially large diameter when rolled onto an assembly for storage.

U.S. Pat. No. 6,422,289, issued to Miller also discloses a rolling shutter assembly for covering a door or window opening. The shutter is designed to be rolled up onto a shutter support member for storage when it is not in use. Many different embodiments of shutter slats are disclosed. In a first embodiment, the slats are curved and may or may not include rollers to assist in guiding the shutter slats in a track as they are raised or lowered. In other embodiments the shutter slats are flat and connected to each other utilizing a variety of different hinge connections. However, none of these embodiments provides a compact and small diameter unit when the shutter is rolled up onto the shutter support member for storage.

U.S. Pat. No. 6,779,582, issued to Heissenberg discloses an accordion type of hurricane shutter assembly for providing a temporary covering across an opening in a building to prevent damage to the interior of the building by wind, debris and water from hurricanes and other severe weather conditions.

U.S. Pat. No. 7,069,700, issued to Heissenberg discloses a system for covering the fasteners which are provided on the exterior walls of buildings for mounting hurricane or storm shutters. The system includes a mounting track for the fasteners and a cover plate which is pivotable about one side of the track. The cover normally covers the fasteners when they are not in use and pivots outwardly to allow access to the fasteners to permit the shutter to be attached to them.

SUMMARY OF THE INVENTION

The present invention is directed to a rolling shutter assembly comprising a plurality of shutter slats which are designed to fit snuggly against each other when in a rolled up state so as to substantially reduce the diameter of the rolled up shutter assembly. This reduction of the diameter of the shutter assembly permits the use of a smaller housing for the shutter assembly. The smaller housing increases the aesthetic appeal of the assembly and decreases the material required for the assembly housing and thus the cost of the shutter assembly. The rolling shutter assembly includes a shutter support member, a shutter coupled to the support member and a plurality of tracks that guide the shutter while it is being raised or lowered. The shutter slats include a hinge connection along each edge portion of the slats.

Accordingly, it is an objective of the instant invention to provide a rolling shutter assembly comprising a plurality of shutter slats designed to fit snuggly against each other when in a stored condition.

It is a further objective of the instant invention to provide a rolling shutter assembly which provides protection for openings in buildings against hurricanes and high winds when in a deployed condition.

It is yet another objective of the instant invention to provide a rolling shutter assembly formed from a plurality of shutter subassemblies wherein each of the slats in a subassembly is the same size or width.

It is a still further objective of the invention to provide a rolling shutter assembly which is substantially smaller in diameter when in a stored position.

Other objects and advantages of this invention will become apparent from the following description taken in conjunction with any accompanying drawings wherein are set forth, by way of illustration and example, certain embodiments of this invention. Any drawings contained herein constitute a part of this specification and include exemplary embodiments of the present invention and illustrate various objects and features thereof.

DETAILED DESCRIPTION OF THE INVENTION

Figure 1:
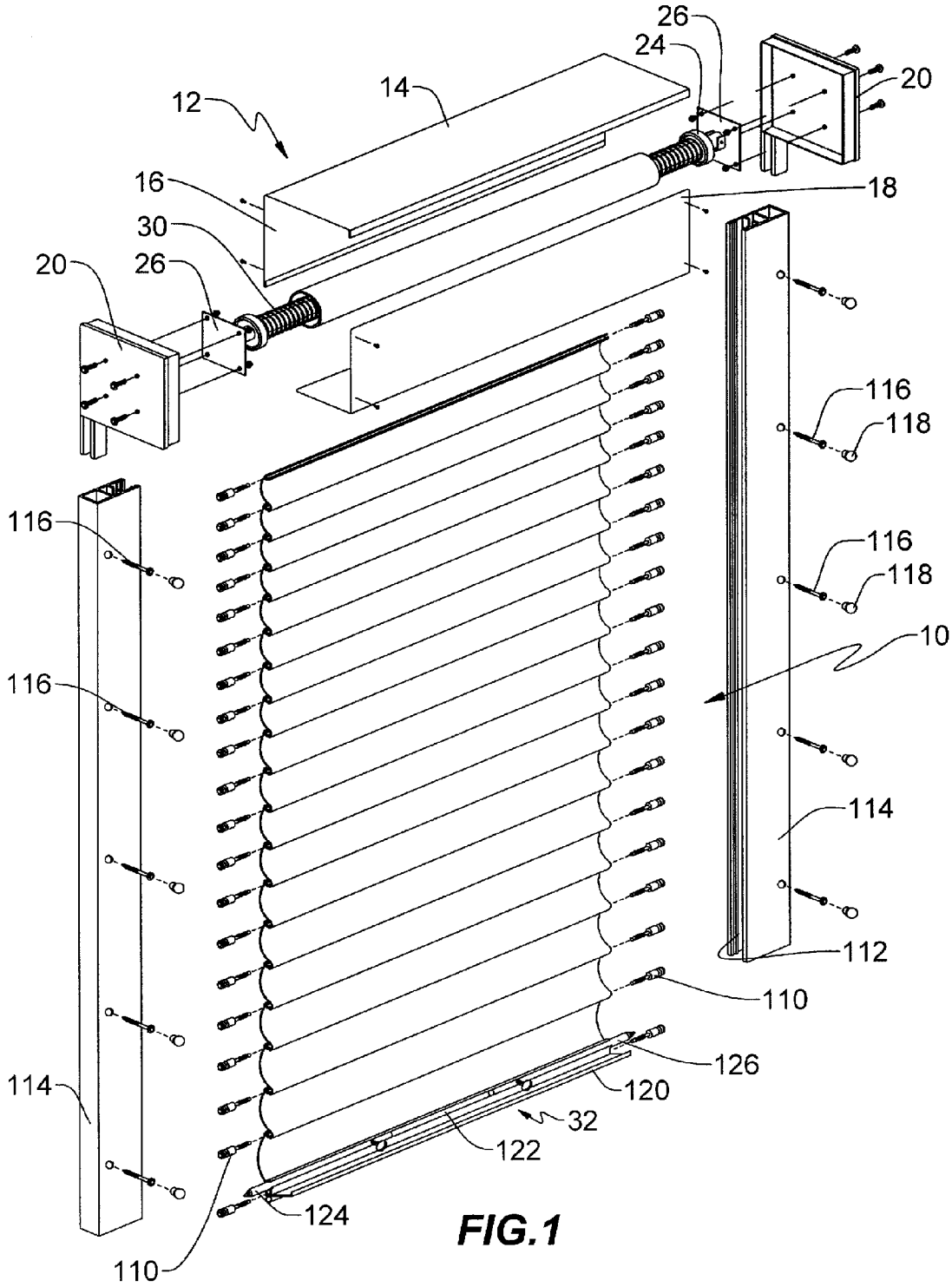
FIG. 1 is an exploded perspective view of the rolling shutter assembly of the present invention.

While the present invention is susceptible of embodiment in various forms, there is shown in the drawings and will hereinafter be described a presently preferred, albeit not limiting, embodiment with the understanding that the present disclosure is to be considered an exemplification of the present invention and is not intended to limit the invention to the specific embodiments illustrated.

As broadly construed, the invention comprises a rolling shutter assembly composed of a plurality of discrete shutter subassemblies. A first subassembly is sized to essentially encircle a shutter mounting member. Each succeeding discrete shutter subassembly is subsequently sized to essentially encircle the previous discrete shutter subassembly, until the desired coverage is achieved. This assemblage of discrete subassemblies is unique in its ability to stack about the shutter mounting member in a particularly compact manner, such that the overall diameter is substantially smaller than prior art rolling shutter assemblies.

Figure 2:
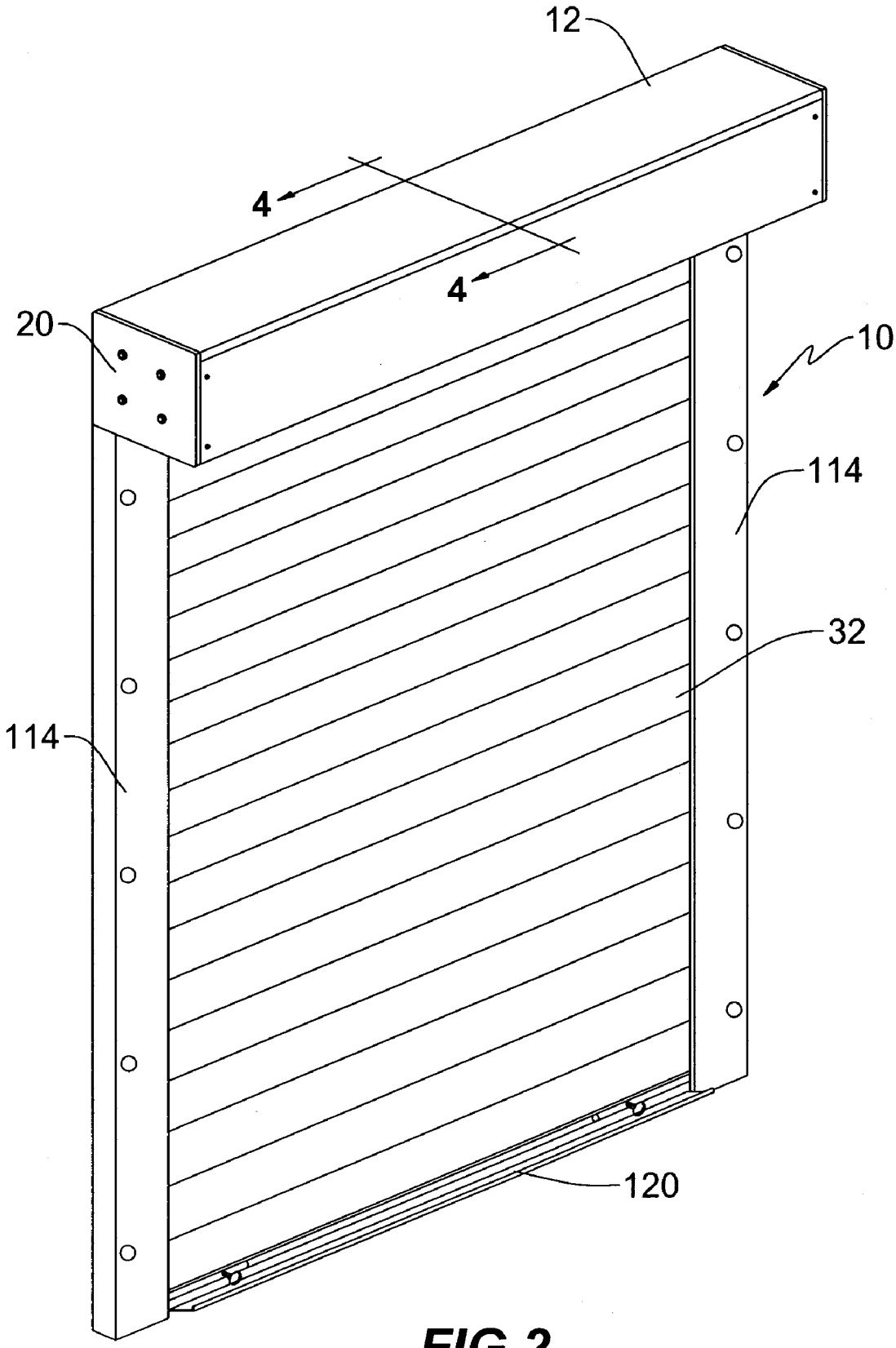
FIG. 2 is a front perspective view of the rolling shutter assembly of the present invention in the deployed position.

An illustrative, albeit non-limiting, embodiment of the rolling shutter assembly 10 of the present invention is illustrated in FIGS. 1 and 2. A shutter assembly housing 12 includes a top wall 14, a rear wall 16, a front wall 18, side walls 20 and a bottom wall 22. A shutter support member 24 is mounted for rotation within the housing on support members 26 connected to the side walls 20 of the housing. A shutter mounting member 28 is secured to a shaft 30 of the shutter support member 24.

Figure 4:
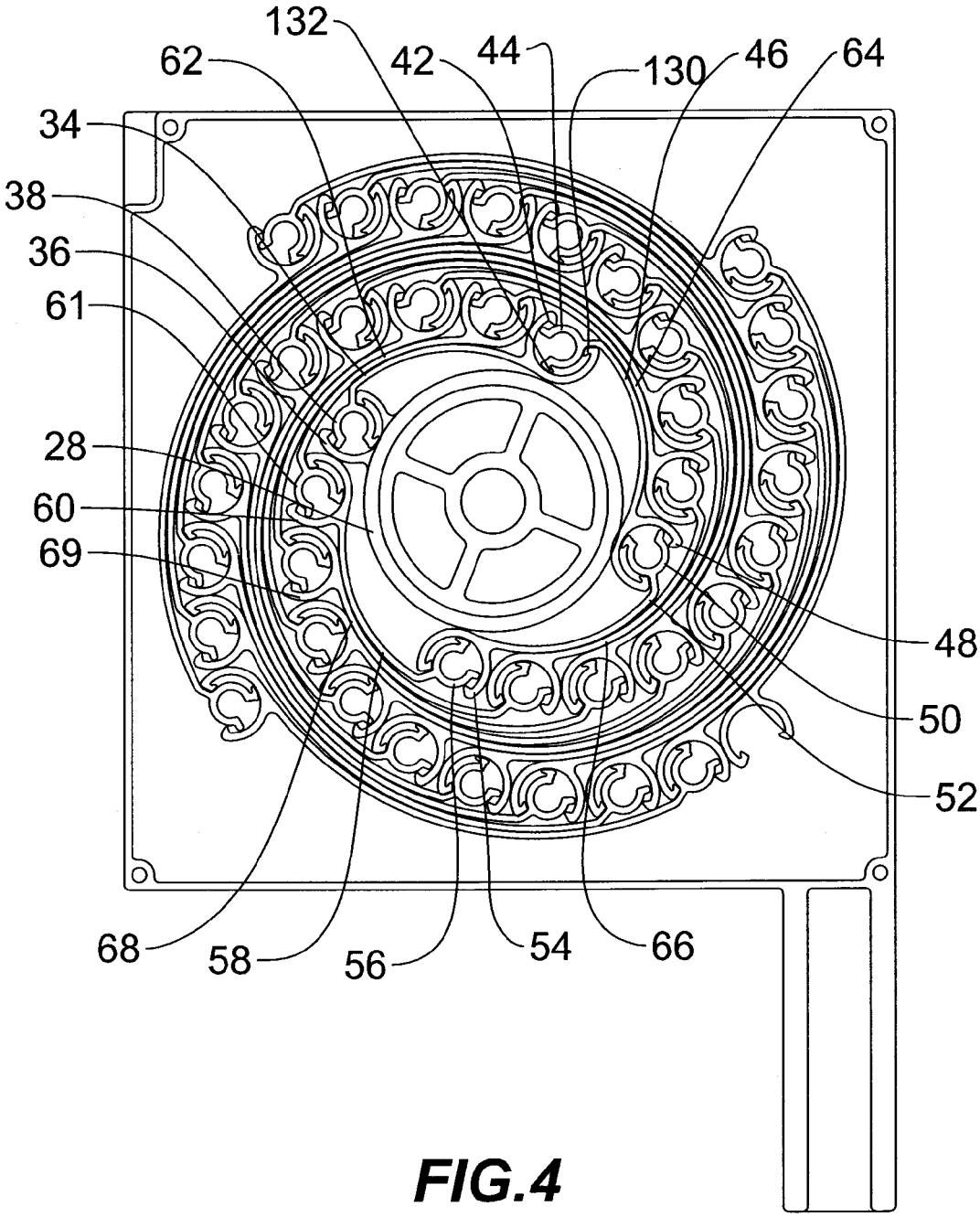
FIG. 4 is cross sectional view of the rolling shutter assembly of the present invention in its stored position along line 4-4 of FIG. 2.
Figures 5A, 5B, 5C, 5D, 5E, 5F, 5G, 5H, 5I, 5J:
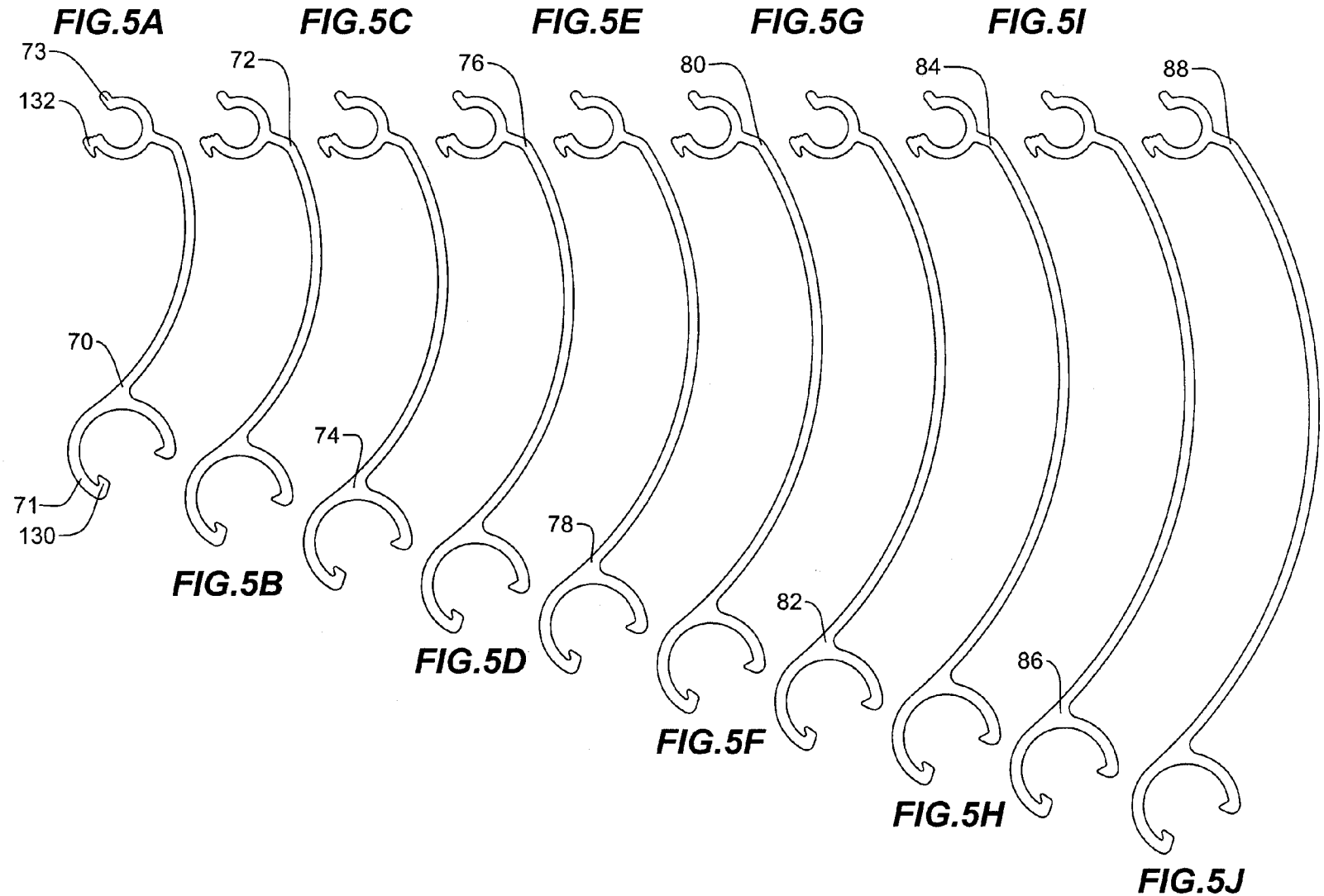
FIGS. 5A-5J are end views of shutter slats of the present invention illustrating their different sizes.

A rolling shutter 32 is illustrated in its unrolled or deployed position in FIGS. 1 and 2. The rolling shutter comprises a plurality of shutter slats secured to each other. An end view of some of the slats 70-88 can be seen in FIGS. 5A-5J. These shutter slats are made from aluminum in a preferred embodiment, but could also be made from steel or any other suitable material. The material must be able to withstand high winds and stop objects carried by these winds from penetrating the openings which the rolling shutter covers. The rolling shutter 32 is attached at its upper portion to shutter mounting member 28 by the top slat 34 of the rolling shutter 32, as illustrated in FIG. 4. A cylindrical socket 36 is secured to or formed on an outer circumferential portion of shutter mounting member 28. A substantially hollow, cylindrical connecting member 38 is secured within cylindrical socket 36. The combination of the connecting member and the cylindrical socket is also known as a knuckle joint. Connecting member 38 is mounted along an edge portion of a shutter slat 34. Another cylindrical socket 42 is mounted along an edge of shutter slat 34 opposite the edge on which connecting member 38 is mounted. The height of shutter slat 34 is the distance between connecting member 38 and cylindrical socket 42. The connecting member 44 of a second shutter slat 46 is secured within cylindrical socket 42. The second shutter slat 46 includes a cylindrical socket 48 mounted along an edge portion thereof. The height of shutter slat 46 is the distance between connecting member 44 and cylindrical socket 48. The connecting member 50 of a third shutter slat 52 is secured within cylindrical socket 48. The third shutter slat includes a cylindrical socket 54 mounted along an edge portion thereof. The connecting member 56 of a fourth shutter slat 58 is secured within cylindrical socket 54 of the third shutter slat. The fourth shutter slat includes a cylindrical socket 60 mounted along an edge portion thereof. The cylindrical socket 60 is positioned adjacent the initial cylindrical socket 36 when the shutter is in its rolled up or stored position. The height of each shutter slat is the distance between the connecting member and the cylindrical socket of each shutter slat. A group of shutter slats is formed utilizing four shutter slats which are all dimensioned and shaped like the shutter slat 70 of FIG. 5A. The heights of all the shutter slats in this group are the same. This group of four shutter slats essentially encircles the shutter mounting member 28. This group of four shutter slats is known as a shutter subassembly.

Attached to shutter slat 58 is a second group or subassembly of four more shutter slats, 62, 64, 66 and 68. These shutter slats utilize the same system of cylindrical sockets and connecting members or knuckles to attach each other together. This is described above in the description of shutter slats 34, 46, 52 and 58. These four shutter slats (62, 64, 66 and 68) essentially encircle the previous four shutter slats 34, 46, 52 and 58. As can be seen in FIG. 4 this second group or subassembly of slats, 62, 64, 66 and 68, nests upon and contacts the innermost subassembly of slats 34, 46, 52 and 58. This second subassembly, 62, 64, 66 and 68 also essentially encircles the innermost subassembly. The cylindrical socket 69 of the fourth slat 68 of the second subassembly is positioned adjacent the cylindrical socket 60 of the fourth slat 58 of the first subassembly of slats. The socket 69 is also adjacent the connecting member 61 of the first slat 62 of the second subassembly, thus forming an almost complete circle. The second subassembly of slats has a diameter only slightly larger than the diameter of the first or innermost subassembly. This arrangement of shutter subassemblies results in a substantially compact rolling shutter assembly when the shutter assembly is in its stored position. The second group or subassembly is formed from four shutter slats dimensioned and shaped like shutter slat 72 in FIG. 5B.

Figure 3A:
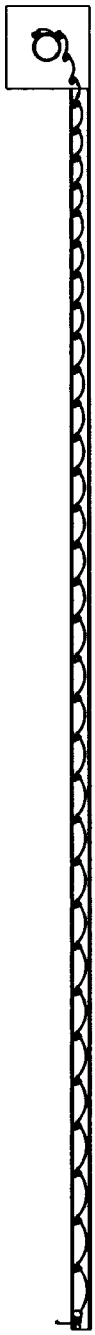
FIGS. 3A and 3B are side views of the roiling shutter assembly of the present invention illustrating different lengths of the shutter assembly in its deployed position.
Figure 3B:
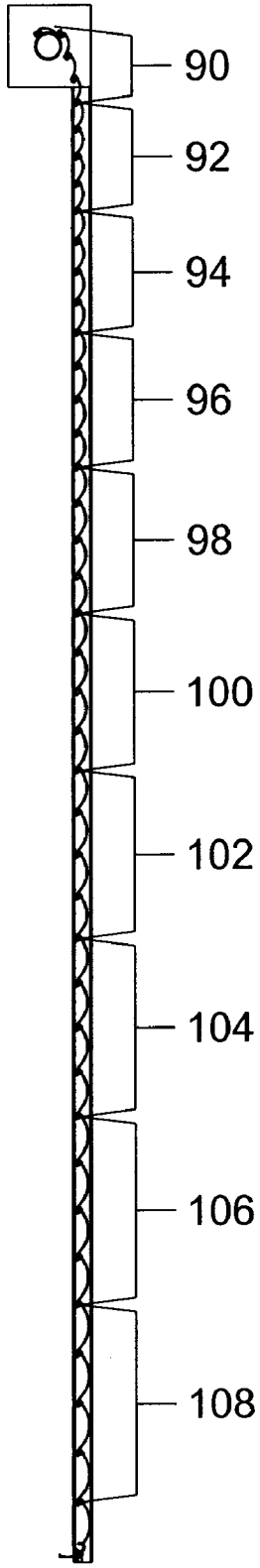

Each succeeding subassembly or group of shutter slats is formed from four shutter slats each having the same size. Each of these four slats has the next larger dimensions than the shutter slat of the previous subassembly. The third subassembly comprises four shutter slats similar to shutter slat 74 in FIG. 5C, the fourth subassembly comprises four shutter slats to shutter slat 76 in FIG. 5D, etc. Each succeeding subassembly of shutter slats nests upon and contacts the previous subassembly of shutter slats, as illustrated in FIG. 4. When the shutter subassemblies are in their deployed position, as illustrated in FIG. 3B, each succeeding subassembly is longer that the preceding shutter subassembly The first shutter subassembly or group 90 is shorter than the second shutter subassembly or group 92 Each of the succeeding shutter subassemblies is sized to fit the remaining portion of the opening being protected by the shutters. The last shutter subassembly may comprise less than four shutter slats. In the embodiment illustrated in FIG. 3B the last shutter subassembly comprises only a single slat. In other embodiments of the invention each of the shutter subassemblies can be formed from more than four shutter slats.

Shutter slats are connected to each other by a connecting member of one shutter slat positioned within a cylindrical socket of the next shutter slat. A guide pin 110 is secured to the connecting member at each end of the shutter slat, as illustrated in FIG. 1. The guide pin 110 moves vertically along a track 112 of guide rail 114. A guide rail 114 is positioned on both the left and right sides of the opening that the rolling shutter assembly is protecting. Guide rails 114 are secured to a building by fasteners 116. Protective caps 118 may be attached to an exposed end of a fastener 116 to protect the fastener from the elements. The plurality of guide pins 110 permit the rolling shutter 32 to be deployed from the housing 12 and rolled up thereinto. The guide pins 110 also secure the shutter slats to the guide rails 114 in a manner such that high winds and flying debris will not move the shutter assembly into the opening which it is covering.

A base plate 120 is secured to the lowermost slat of the rolling shutter 32, as illustrated in FIG. 1. The base plate is attached to the cylindrical socket of the lowermost shutter slat of the rolling shutter 32. The base plate 120 rests against the ground and prevents the intrusion of the weather elements such as wind and rain and also insects. A bar 122 is secured in the cylindrical socket of the lowermost slat. The bar 122 is provided with a left and a right movable end members 124 and 126. The movable end members are normally retracted into the bar 122 and do not extend past the end of the shutter slat. When the rolling shutter 32 is unrolled to its fully deployed position, the end members 124 and 126 are extended outwardly and into the track 112 of the guide rails 114. The bar 122 and end members 124, 126 helps to secure base plate 120 and lowermost end of the rolling shutter 32 to the lowermost portion of guide rail 114. Means can be provided to lock the end members 124 and 126 to the guide rails 114.

Shutter slats are also prevented from pivoting inwardly into the opening by a plurality of hooks formed on the connecting members and cylindrical sockets. Shutter slat 70, FIG. 5A, has a hook 130 formed on an inner portion of its cylindrical socket 71. The hook 130 extends substantially the length of cylindrical socket 71. Another hook 132 is formed on the outer portion of the connecting member 73 of slat 70. The operation of these hooks will now be described utilizing the rolling shutter assembly of FIG. 4. A hook 130 is formed on the inner portion of cylindrical socket 42 of the first shutter slat 34. A corresponding hook 132 is formed on the outer portion of connecting member 44 of the second slat 46. When the slats are deployed from their stored position the connecting member 44 of slat 46 rotates counterclockwise with respect to the cylindrical socket 42 of slat 34. The hooks 130 and 132 engage each other when the slats unroll to a vertical position, as shown in FIG. 1. This arrangement prevents the rolling shutter 32 from pivoting and flexing in a direction opposite to the direction in which it is rolled up for storage. This enhances its protection against high winds.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A retractable rolling shutter assembly operable between a deployed condition and a stored condition comprising;

a shutter support member;

an initial discrete shutter subassembly having a plurality of individual slats in mechanical engagement with one another;

said initial discrete shutter subassembly having a length effective to essentially encircle said shutter support member when stored thereabout;

at least one subsequent shutter subassembly having a plurality of individual slats in mechanical engagement with one another;

each of said slats having a body portion, a top edge extending along a top portion of said body portion, a bottom edge extending along a bottom portion of said body portion;

a top connecting element connected to said top edge;

a bottom connecting element connected to said bottom edge;

said top connecting element of one of said slats being connected to said bottom connecting element of another of said slats thereby forming a joint;

the distance between said top and said bottom connecting elements of each said slat define a height of said slat;

each of said slats in each said shutter subassembly has the same height and the height of said slats in different shutter subassemblies is different from the height of said slats in other subassemblies;

the height of said slats in said shutter subassemblies increases as the distance from said shutter support member to said shutter subassembly increases;

said at least one subsequent shutter subassembly having a length effective to essentially encircle said initial or previously deployed discrete shutter subassembly in its stored condition, whereby each said shutter subassembly nests upon said previously deployed shutter subassembly when said shutter subassemblies are in their stored positions and said joints of said shutter subassembly being juxtaposed but not overlapping corresponding joints of said previously deployed shutter subassembly thereby decreasing the overall dimensions of said rolling shutter assembly;

said body portion of said slats of each said shutter subassembly are in contact with said body portion of said slats of said previously deployed shutter subassembly when said rolling shutter assembly is in its stored position.

2. The retractable rolling shutter assembly of claim 1, wherein said top and said bottom connecting elements are substantially cylindrical and one of said top or bottom connecting elements is positioned within the other of said top or bottom connecting elements thereby forming a pivotal connection between adjacent slats.

3. The retractable rolling shutter assembly of claim 2, wherein hooks are integrally formed on said top and bottom connecting elements, said hooks engage each other to prevent the rotation of said slats past a certain point with respect to each other.

4. The retractable rolling shutter assembly of claim 1, wherein each of said slats is curved along a plane extending from one edge to the other edge.

5. The retractable rolling shutter assembly of claim 1, additionally comprising a housing which substantially encloses said rolling shutter assembly when said rolling shutter assembly is in its stored position.

6. The retractable rolling shutter assembly of claim 5, additionally comprising a plurality of tracks secured to sides of an opening;

attaching elements secured to said slats and positioned within said tracks when said rolling shutter assembly is in said deployed condition, whereby said rolling shutter assembly is secured against said opening to prevent the intrusion of wind and other objects into said opening.

* * * * *